United States Patent [19]

Boublil

[11] Patent Number: 4,941,216

[45] Date of Patent: Jul. 17, 1990

[54] LIFT FOR GIVING ACCESS TO THE WATER IN A SWIMMING BATH OR A RE-EDUCATION POOL

[76] Inventor: David Boublil, 9, rue de Brément, F-93130 Noisy-le-Sec, France

[21] Appl. No.: 187,059

[22] PCT Filed: Jul. 28, 1987

[86] PCT No.: PCT/FR87/00296

§ 371 Date: Apr. 1, 1988

§ 102(e) Date: Apr. 1, 1988

[87] PCT Pub. No.: WO88/00820

PCT Pub. Date: Feb. 11, 1988

[30] Foreign Application Priority Data

Aug. 1, 1986 [FR] France ..... 86 11170

[51] Int. Cl.[5] ..... A61G 7/10

[52] U.S. Cl. ..... 4/496; 5/81 R; 5/83; 212/253; 414/921

[58] Field of Search ..... 4/555, 559, 566, 496; 5/81 R, 81 B, 83; 414/541, 543, 921, 542; 272/28 R, 28 S, 29; 248/404, 416; 187/1 R, 9 R, 17; 212/134, 223, 253

[56] References Cited

U.S. PATENT DOCUMENTS

| | | | |
|---|---|---|---|
| 2,650,647 | 9/1953 | MacKnight | 248/416 |
| 3,182,826 | 5/1965 | Mutto | 414/541 |
| 4,183,106 | 1/1980 | Grimes et al. | 4/172 |
| 4,554,691 | 11/1985 | Daugherty | 5/81 R |
| 4,571,758 | 2/1986 | Samuelsson | 5/86 |

FOREIGN PATENT DOCUMENTS

| | | | |
|---|---|---|---|
| 138458 | 11/1979 | Fed. Rep. of Germany | 4/559 |
| 33140 | 2/1985 | Japan | 414/453 |

*Primary Examiner*—Henry J. Recla
*Assistant Examiner*—R. M. Fetsuga

[57] ABSTRACT

A lift for putting a handicapped person into the water of a swimming bath or pool comprises a top plate, a bottom plate, a base plate secured to the ground, a fixed support post mounted on the base plate and comprising a steel tube welded to the top plate and a stainless steel tubular shaft centered in the steel tube, a rotation block rotatably mounted on the tubular shaft, and a guide column or plate. The rotation block comprises a frame provided at the rear with concentric bearings pivoting around the tubular shaft, a bearing plate positioned inside the frame, a rod mounted on and secured to the tubular shaft, and a horizontal jack mounted at its rear end to the bearing plate. The nose of the jack is connected to the rod for pivotally mounting the rotation block on the tubular shaft. The guide plate comprises a fixed upright secured to the front surface of the rotation block, a moving upright slidably mounted to the fixed upright, and a vertical jack secured inside the fixed upright for moving the moving upright with respect to the fixed upright. A seat is secured to the moving upright. A rotation wheel is secured to the rear surface of the fixed upright at the bottom. The rotation wheel includes wheels resting on the base plate for completely stabilizing the device and for distributing any loads and forces exerted on the guide plate and the tubular shaft.

8 Claims, 5 Drawing Sheets

LIFT FOR GIVING ACCESS TO THE WATER IN A SWIMMING BATH OR A RE-EDUCATION POOL

BACKGROUND OF THE INVENTION

The invention relates to means and equipment for giving access to water to handicapped people with reduced mobility, so that they can independently and effortlessly enter and leave the water of a swimming-bath or re-education pool without having to use an access slope or ladder or steps.

Existing equipment nearly always requires at least one operator or assistance in entering and leaving the water.

SUMMARY OF THE INVENTION

The aim of the device according to the invention is:

(a) to enable handicapped persons, persons with reduced mobility, or elderly or pregnant women to enter and leave the water by use of their own powers, without effort and without help from anyone else;

(b) to be simple and extremely reliable;

(c) to be completely automatic without requiring electricity or compressed air;

(d) to operate on tap water;

(e) not to require any maintenance, and (f) in conjuction with a suitable litter, to give access to the water when lying down.

These and other objects of the invention are achieved through the provision of a device comprising a top plate, a bottom plate, a base plate secured to the ground, a fixed support post mounted on the base plate and comprising a steel tube welded to the top plate and a stainless steel tubular shaft centered in the steel tube, a rotation block rotatably mounted on the tubular shaft, and a guide column or plate. The rotation block comprises a frame provided at the rear with concentric bearings pivoting around the tubular shaft, a bearing plate positioned inside the frame, a rod mounted on and secured to the tubular shaft, and a horizontal jack mounted at its rear end to the bearing plate. The nose of the jack is connected to the rod for pivotally mounting the rotation block on the tubular shaft. The guide plate comprises a fixed upright secured to the front surface of the rotation block, a moving upright slidably mounted to the fixed upright, and a vertical jack secured inside the fixed upright for moving the moving upright with respect to the fixed upright. A seat is secured to the moving upright.

In one aspect of the invention, the fixed upright is provided with flanges extending from its side and roller trains secured to the flanges, and the moving upright is provided with rails secured to its sides, the roller trains of the fixed upright rolling inside the rails of the moving upright.

In another aspect of the invention, a rotation wheel is secured to the rear surface of the fixed upright at the bottom. The rotation wheel includes wheels resting on the base plate for completely stabilizing the device and for distributing any loads and forces exerted on the guide plate and the tubular shaft.

In yet another aspect of the invention, tap water is supplied to the vertical and horizontal jacks by first and second three-position distributors, respectively.

A better understanding of the disclosed embodiments of the invention will be achieved when the accompanying detailed description is considered in conjunction with the appended drawings, in which like reference numerals are used for the same parts as illustrated in the different figures.

DESCRIPTION OF THE PREFERRED EMBODIMENTS

The device according to the invention is made up of simple dismountable components, as shown in the accompanying drawings.

Figure 1:
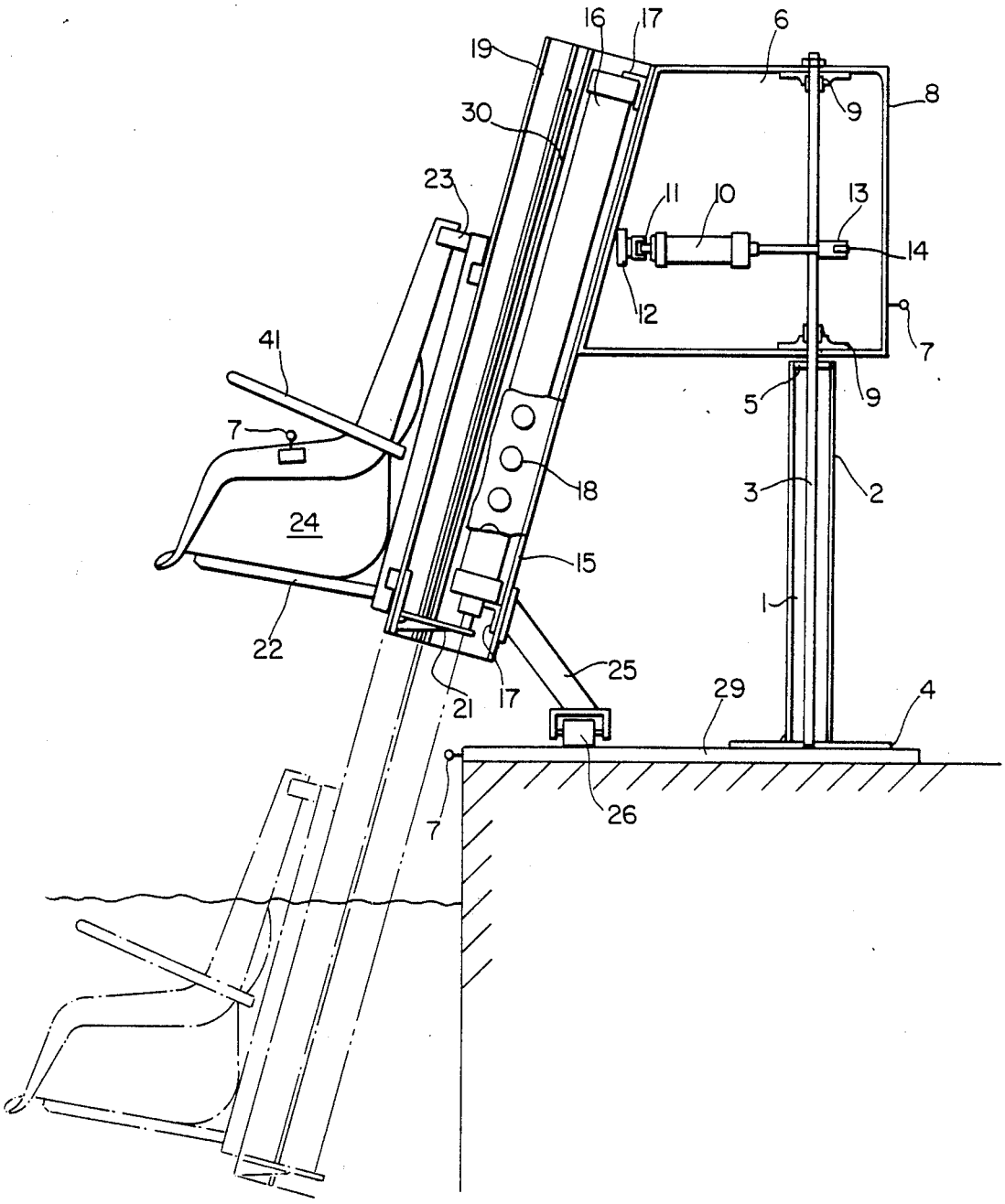
FIG. 1 is a side elevational view of the device for putting a handicapped person into the water according to the invention, with parts broken away, the lower position of the seat and moving upright being shown and dotted lines.

It comprises a fixed support post (1), a rotation block (6), a guide column or plate (30), and a rotation foot (25):

The fixed support post (1) comprises a square or round approximately 100-mm tube (2) about 1100 mm high, inside which an approximately 45-mm tubular shaft (3) is centered and welded at one end to a base (4) and at the other end to a top plate (5) which in turn is welded to the tube (2). The welded assembly is secured to a baseplate (29) secured to the edge of the bath, as shown as, FIG. 1.

Figure 2:
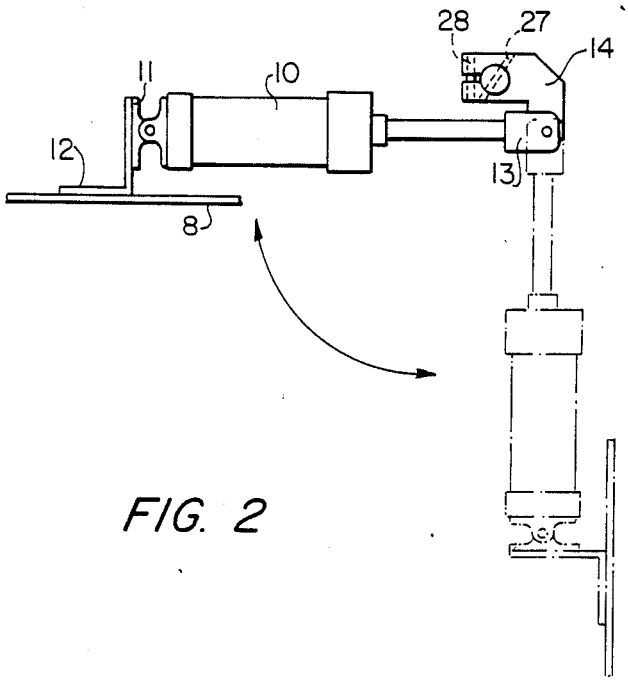
FIG. 2 is a top plan view of the horizontal jack of the device of FIG. 1.
Figure 3:
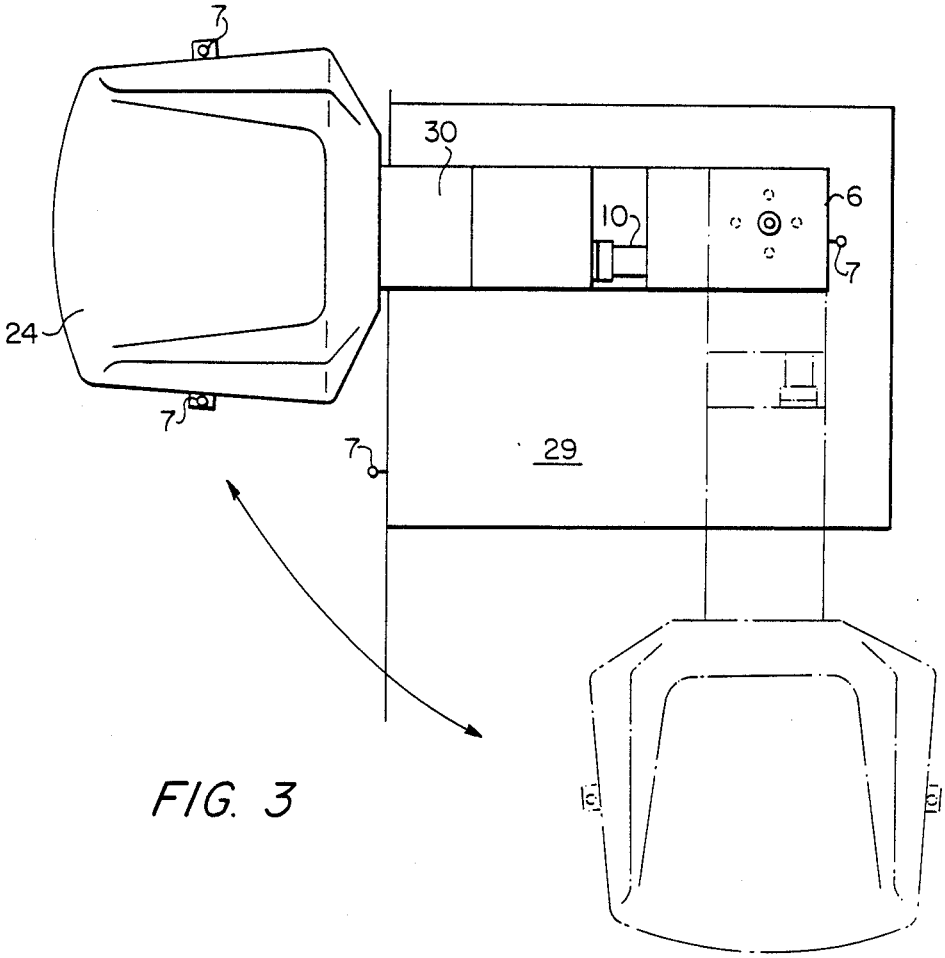
FIG. 3 is a top plan view of the device of FIG. 1.
Figure 4:
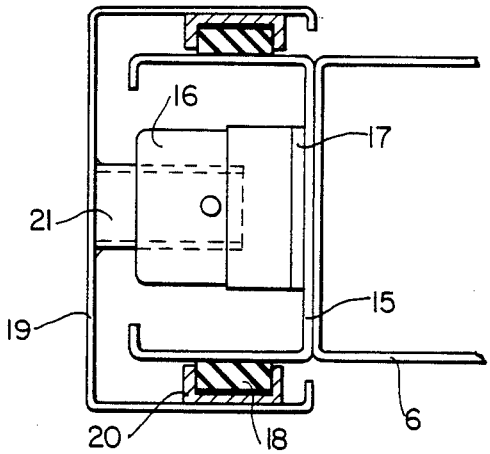
FIG. 4 is a cross-sectional view of a first embodiment of the mounting mechanism for the moving upright of the device shown in FIG. 1.
Figure 5:
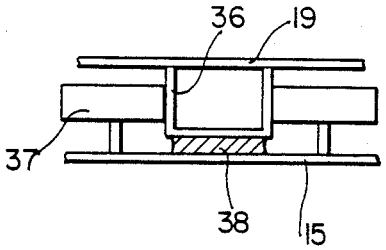
FIG. 5 is a cross-sectional view of a second embodiment of a mounting mechanism for the moving upright of the device shown in FIG. 1.
Figure 6:
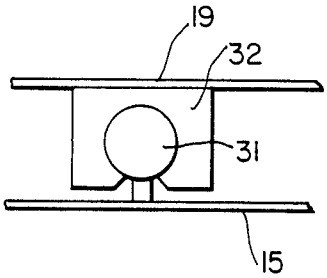
FIG. 6 is a third embodiment of a mounting mechanism for the moving upright of the device shown in FIG. 1.
Figure 7:
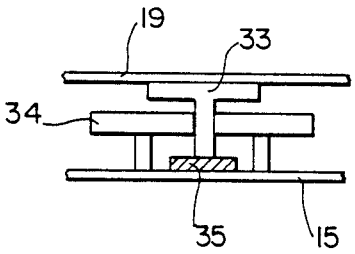
FIG. 7 is a fourth alternative of a mounting mechanism for the moving upright of the device shown in FIG. 1.
Figure 8:
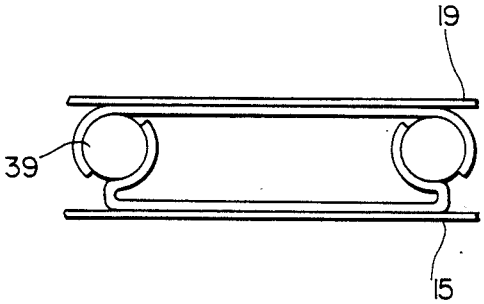
FIG. 8 is a fifth embodiment of the mounting mechanism for the moving upright of the device shown in FIG. 1.

The rotation block (6) is an assembly comprising a frame (8) of bent sheet metal, a parallelepipedal mechanically welded or reinforced plastics assembly having a sloping front surface equipped at the rear of the upper and lower surfaces with two concentric guide rings or bearings (9) for rotation, so as to be mounted on the tubular shaft (3). A horizontal jack (10) about 63 mm in diameter and having a stroke of e.g. 200 mm is secured on a bearing plate (12) inside the rotation block (6), on the one hand via a rear joint (11) and on the other hand via a strap (13) secured to the nose of the jack connected to a rod (14) mounted on and secured to the tubular shaft (3) by a pin system (27) and a clamping system (28). The rotation block can thus pivot through e.g. 90 degrees, as shown in FIG. 2.

The guide column (30) comprises a fixed upright (15) having a "U" or "C" section and secured to the front surface of the rotation block (6), a vertical jack (16) 80 mm in diameter and having a stroke of e.g. 1200 mm being mounted inside the guide column and having its nose downwards and equipped with securing brackets (17). Two trains of rollers (18) are secured to the two flanges of the upright and slide inside "U" shaped rails (20) secured to a moving upright (19) which has a "U" or "C" section and at the lower part of which a gusset (21) is mounted for securing the nose of the jack (16). When thus assembled, the two uprights move one another through a length corresponding to the stroke of the jack. The two uprights may alternatively be guided by ball slideways (39) or e.g. a cylindrical or other shaft (31) sliding in a ring (32) which can be a ball race or the guide means cna be a "T" section member (33) on which rollers (34) move on each surface of the "flats", the edges of which rub against a wear plate (35) or a "U" (36) whose two flanges serve as a running surface for the rollers (37) and a wear plate (38) which is in contact with the front surface for guide or other purposes, as shown in FIGS. 4, 5, 6, 7 and 8.

Sleeves are secured to the lower part of the flanges of the upright (19) and serve as a recess for the connecting bars (22) to which a seat (24) equipped with two controls (7) is secured.

The guide column (30) is secured to the end of the rotation block (6), either vertically or inclined at e.g. 15 or 20 degrees.

The rotation foot (25) is secured to the bottom part of the fixed upright (15) and is equipped with wheels (26) which rest on the baseplate (29) so that the assembly is perfectly stable with good distribution of loads and any forces exerted on the guide column (30) or the tubular shaft (3).

The device operates completely automatically and uses tap water. The various movements are controlled at four points. The seat is equipped with a right-hand control (27*a*) and a left-hand control (27*b*) in order to facilitate manipulation depending on the bather's handicap.

Figure 9:
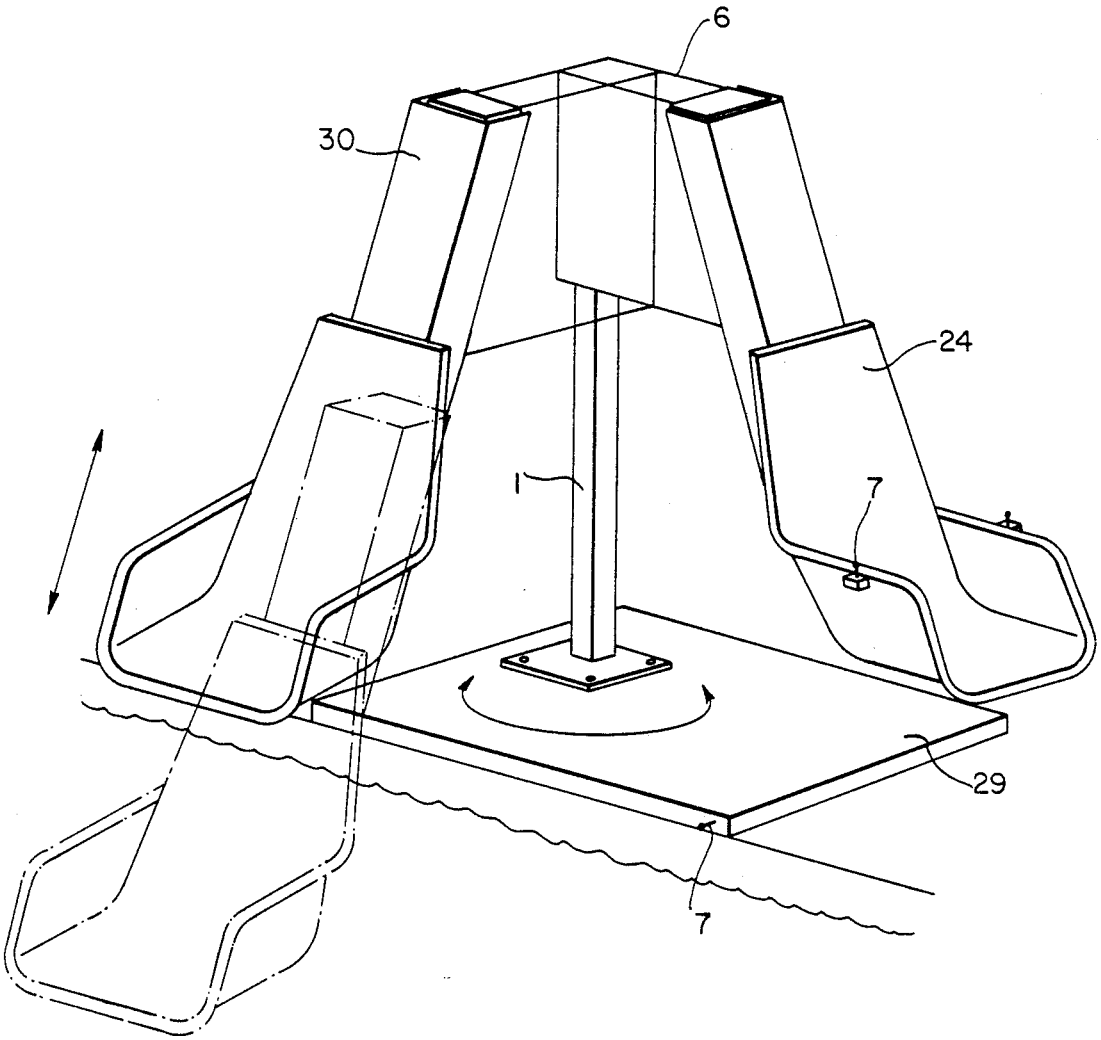
FIG. 9 is a perspective view of the device shown in FIG. 1.

A control (27*c*) on the rotation block enables the bather to raise the device when in the water, and another control (27*d*) disposed on the edge of the support plate (29) enables the bather when in the water to lower the device, which is in the "inoperative" position on the support plate (29), as shown in, FIG. 9.

Figure 10:
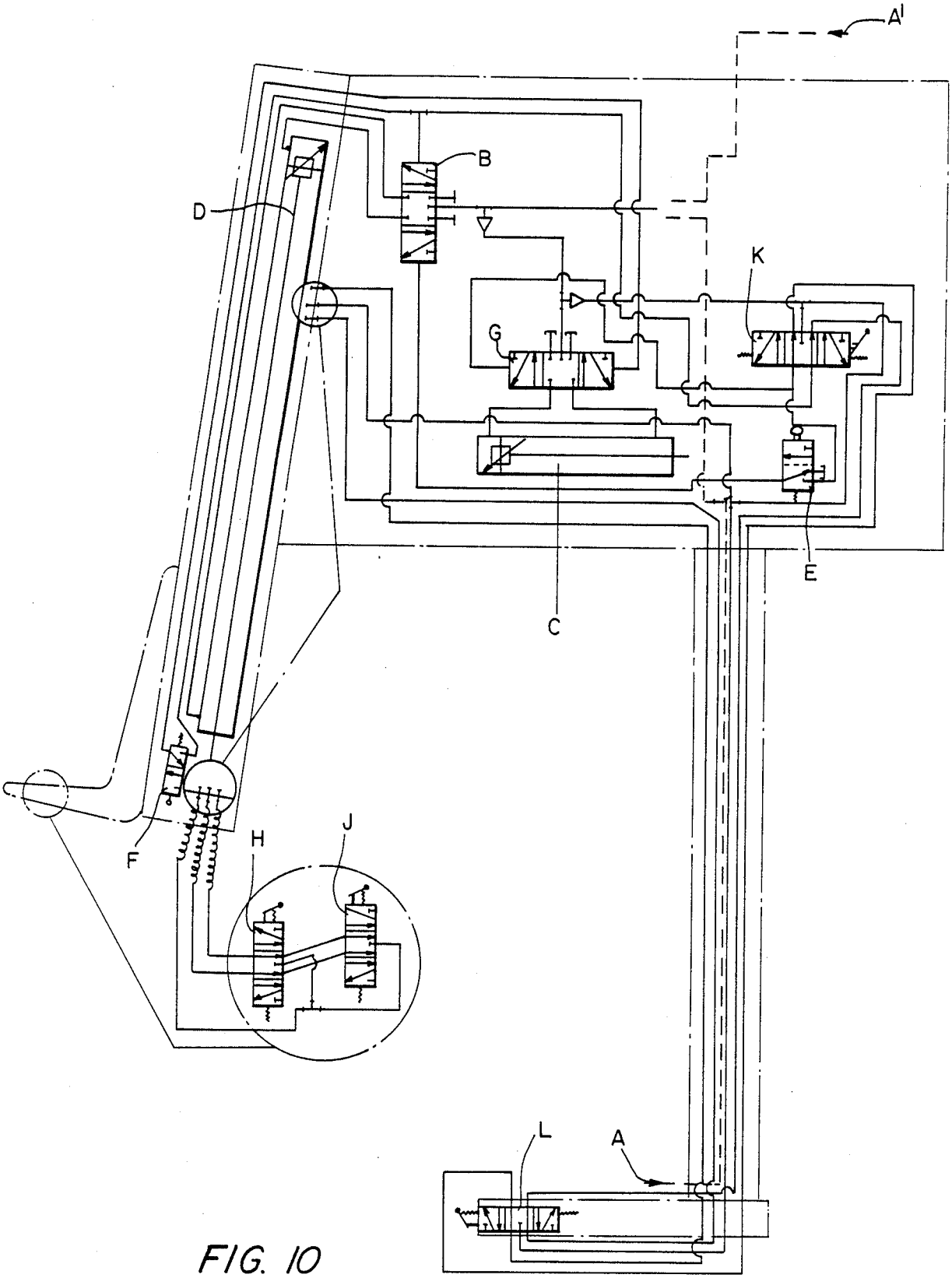
FIG. 10 is a diagram of the control mechanism for the device of FIG. 1.

FIG. 10 shows the complete operation of the device.

The device can be supplied with water at the bottom at A or at the top at A1, via the 3-position distributor B which supplies the vertical jack D and towards the 3-position distributor G which supplies the horizontal jack C. E and F are distributors comprising rollers and automatic control of end of travel and used for actuating the distributors B and G to move as required. The end of travel of distributors E and F enable the four controls (7) to operate in a continuous cycle, marked H, J, K, L in FIG. 10.

What is claimed:

1. A device for giving access to water to persons with reduced mobility, comprising:

a top plate;

a bottom plate;

a baseplate secured to the ground;

a fixed support post mounted on said baseplate and comprising a steel tube welded to said top plate and a stainless steel tubular shaft centered in said steel tube, said tubular shaft having a bottom end welded to said bottom plate and a top end welded to said top plate;

a rotation block rotatably mounted on said tubular shaft, said rotation block comprising a parallelepipedal frame having front, upper, and lower surfaces, said front surface being sloping and said upper and lower surfaces having a rear and being provided at said rear with completely concentric bearings, said bearings pivoting exactly around said tubular shaft, a bearing plate positioned inside said frame, a rod mounted on and secured to said tubular shaft, pin means and clamping means for securing said rod to said tubular shaft, a horizontal jack having a rear end and a nose, said rear end of said horizontal jack being secured inside said frame on said bearing plate, rear joint means for securing said rear end of said horizontal jack to said bearing plate, and strap means screwed to said nose of said jack and connected to said rod for pivotally mounting said rotation block on said tubular shaft;

a guide plate comprising a fixed upright secured to said front surface of said rotation block, said fixed upright having a top, a bottom, first and second sides, a rear surface, and upper and lower brackets mounted to said top and bottom, respectively;

a moving upright having a top, a bottom, first and second sides, and a gusset mounted at said bottom, said moving upright sliding in said fixed upright;

slide means for mounting said moving upright to said fixed upright for up-and-down sliding motion;

a vertical jack secured inside said fixed upright by said upper and lower brackets, said vertical jack having a nose and an upper end, said nose being secured to said bottom of said moving upright by said gusset, said vertical jack moving said moving upright with respect to said fixed upright over a distance corresponding to the length of the stroke of said vertical jack; and a seat secured to said moving upright.

2. The device of claim 1, said base plate being made of stainless steel.

3. The device of claim 1, said frame and said guide plate being made of reinforced plastics.

4. The device of claim 1, said fixed upright having first and second flanges extending from said first and second sides thereof and first and second trains of rollers secured to said first and second flanges, respectively, and said moving upright having first and second rails secured to said first and second sides thereof, said first and second trains of rollers rolling inside said first and second rails, respectively, said first and second flanges, said first and second trains of rollers, and said first and second rails comprising said sliding means.

5. The device of claim 1, further comprising a rotation wheel secured to said rear surface of said fixed upright at said bottom, said rotation wheel including wheel means resting on said baseplate for completely stabilizing said device and for distributing any loads and forces exerted on said guide plate and said tubular shaft.

6. The device of claim 1, said seat having a lower part, a left side, a right side, left-hand and right-hand control means secured to said lower part for controlling said horizontal and vertical jacks, and left and right movable arm rests secured to said lower part, said seat having an ergonomic shape and being made of polyester.

7. The device of claim 1, said device being completely automatic and powered by water from a tap and having first, second, third, and fourth control means for controlling the motion of said device, said first and second control means comprisng left-hand and right-hand control means provided on said seat for facilitating manipulation depending on the bather's handicap, said third control means comprising raising means provided on said rotation block for enabling the bather to raise said seat when in the water; and said fourth control means comprising lowering means provided on the edge of said base plate for enabling the bather when in the water to lower said seat into the pool.

8. The device of claim 1, further comprising first three-position distributor means for supplying tap water to said vertical jack and second three-position distributor means for supplying tap water to said horizontal jack.

* * * * *